US007140207B2

(12) United States Patent
Badiali et al.

(10) Patent No.: US 7,140,207 B2
(45) **Date of Patent: *Nov. 28, 2006**

(54) DEVICE FOR THE CONTINUOUS TREATMENT OF YARNS WITH PROCESS FLUIDS

(75) Inventors: Roberto Badiali, Pordenone (IT); Mario Minuti, Soresina (IT)

(73) Assignee: Savio Macchine Tessili S.p.A., Pordenone (IT)

( * ) Notice: Subject to any disclaimer, the term of this patent is extended or adjusted under 35 U.S.C. 154(b) by 401 days.

This patent is subject to a terminal disclaimer.

(21) Appl. No.: 10/446,905

(22) Filed: May 28, 2003

(65) Prior Publication Data

US 2003/0226381 A1 Dec. 11, 2003

(30) Foreign Application Priority Data

Jun. 5, 2002 (IT) ..... MI2002A001221

(51) Int. Cl.
*D06B 1/00* (2006.01)

(52) U.S. Cl. ..... 68/177; 68/178; 68/179

(58) Field of Classification Search ..... 8/151.2, 8/152; 68/175, 176, 177, 178, 179
See application file for complete search history.

(56) References Cited

U.S. PATENT DOCUMENTS

| | | | | | |
|---|---|---|---|---|---|
| 42,782 | A | * | 5/1864 | Meyer | 68/9 |
| 1,371,055 | A | * | 3/1921 | Robertson et al. | 68/177 |
| 1,418,136 | A | * | 5/1922 | Dreaper | 57/295 |
| 1,437,340 | A | * | 11/1922 | Dreaper | 57/2 |
| 1,555,864 | A | * | 10/1925 | McConnell | 68/175 |
| 1,665,624 | A | * | 4/1928 | Conrad | 68/62 |
| 1,691,701 | A | * | 11/1928 | Carlson et al. | 8/150 |
| 1,858,073 | A | * | 5/1932 | Cole | 493/414 |
| 1,955,719 | A | * | 4/1934 | Malkomes | 8/155.1 |
| 2,131,409 | A | | 9/1938 | Nai | |
| 2,581,018 | A | * | 1/1952 | Hatay | 26/18.5 |
| 2,725,276 | A | * | 11/1955 | Griset, Jr. | 8/151.2 |
| 2,947,595 | A | * | 8/1960 | Moelter | 8/151.2 |
| 3,064,328 | A | * | 11/1962 | McClure et al. | 53/116 |
| 3,083,437 | A | * | 4/1963 | Davis, Jr. | 53/504 |
| 3,234,627 | A | * | 2/1966 | Russo et al. | 28/289 |
| 3,281,913 | A | * | 11/1966 | Morehead et al. | 53/430 |
| 3,330,134 | A | | 7/1967 | Carpenter | |
| 3,378,898 | A | * | 4/1968 | Mendes | 28/289 |
| 3,397,437 | A | * | 8/1968 | McNeill et al. | 53/409 |
| 3,423,807 | A | * | 1/1969 | Couturier et al. | 53/116 |
| 3,497,311 | A | | 2/1970 | Masuda | |

(Continued)

FOREIGN PATENT DOCUMENTS

DE 1 510 248 * 10/1970

(Continued)

OTHER PUBLICATIONS

WIPO WO 02/22928 Mar. 2002.*

(Continued)

*Primary Examiner*—Frankie L. Stinson
(74) *Attorney, Agent, or Firm*—Hedman & Costigan PC; James V. Costigan

(57) ABSTRACT

Device for the continuous treatment of yarns with process fluids comprising a Venturi nozzle fed with process fluid as driving fluid to feed the yarn to the treatment, a distributor for distributing the yarn in the treatment reactor according to a layer of superimposed swirls, a tank reactor, internally equipped with a saddle-shaped guiding surface on which the threads arranged in a layer first descend for immersion and then rise emerging from the process fluid.

8 Claims, 2 Drawing Sheets

Figures 1A, 1B, 1C:
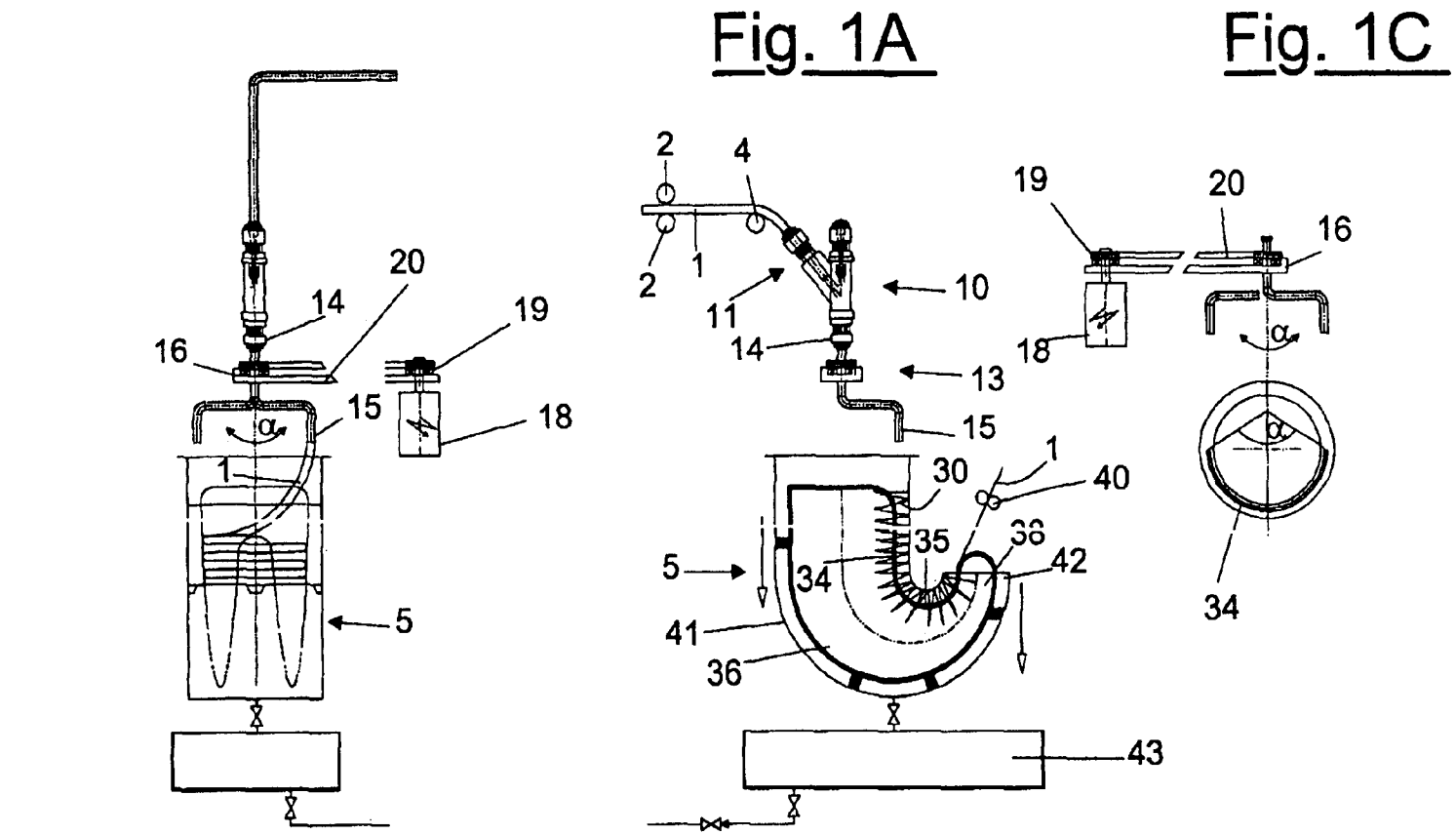

U.S. PATENT DOCUMENTS 3,580,445 A * 5/1971 Moore, Jr. ..... 226/97.4
3,587,256 A 6/1971 Spara
3,605,146 A * 9/1971 Amengual ..... 8/151.1
3,606,655 A 9/1971 Oberlander et al.
3,616,663 A * 11/1971 Matsuda ..... 68/184
3,621,680 A * 11/1971 Masuda ..... 68/177
3,767,360 A * 10/1973 Singh ..... 8/137.5
3,781,951 A * 1/1974 Stanley ..... 28/257
3,782,138 A * 1/1974 Kawasaki et al. ..... 68/177
3,849,847 A * 11/1974 Corbiere ..... 28/218
3,887,347 A * 6/1975 Reese ..... 65/451
4,006,612 A 2/1977 Theis
4,041,559 A 8/1977 von der Eltz
4,074,901 A * 2/1978 Catallo ..... 493/413
4,080,772 A * 3/1978 Chambley et al. ..... 53/116
4,120,143 A * 10/1978 Chambley et al. ..... 57/293
4,408,378 A * 10/1983 Ketteringham et al. ..... 28/289
4,654,910 A * 4/1987 Kusuki et al. ..... 8/151.2
4,656,846 A * 4/1987 Damm ..... 68/207
4,793,014 A * 12/1988 Luigi ..... 8/152
4,837,903 A * 6/1989 Takemae et al. ..... 28/254
4,862,546 A * 9/1989 von der Eltz et al. ..... 8/149.1
5,046,209 A * 9/1991 Keilhack ..... 8/152
5,621,937 A * 4/1997 Georgantas ..... 8/149.3
5,644,818 A * 7/1997 Price et al. ..... 19/159 R
6,145,278 A * 11/2000 Tanaka ..... 53/430
6,654,910 B1 * 11/2003 Eibach et al. ..... 714/37

FOREIGN PATENT DOCUMENTS

DE 26 16 922 10/1977
EP 0 314 039 5/1989
FR 1. 584 999 1/1970
FR 2 371 539 6/1978
GB 2 004 927 * 4/1979
GB 2004927 A 4/1979
GB 2 073 797 * 10/1981
GB 2 074 132 * 10/1981
JP 61-83310 * 4/1986
JP 61-124479 * 6/1986
JP 1-321972 * 12/1989
JP 2-14065 * 1/1990

OTHER PUBLICATIONS

Communication Pursuant to Article 96(2) EPC, Jul. 4, 2006.

* cited by examiner 1
2
4
5
10
11
13
14
15
16
18
19
20
30
33
34
35
36
40
41
42
43
α

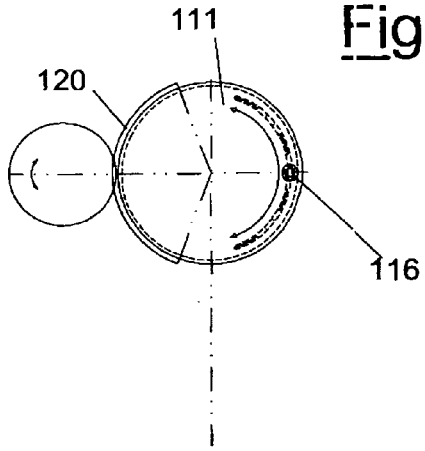
Fig. 2C
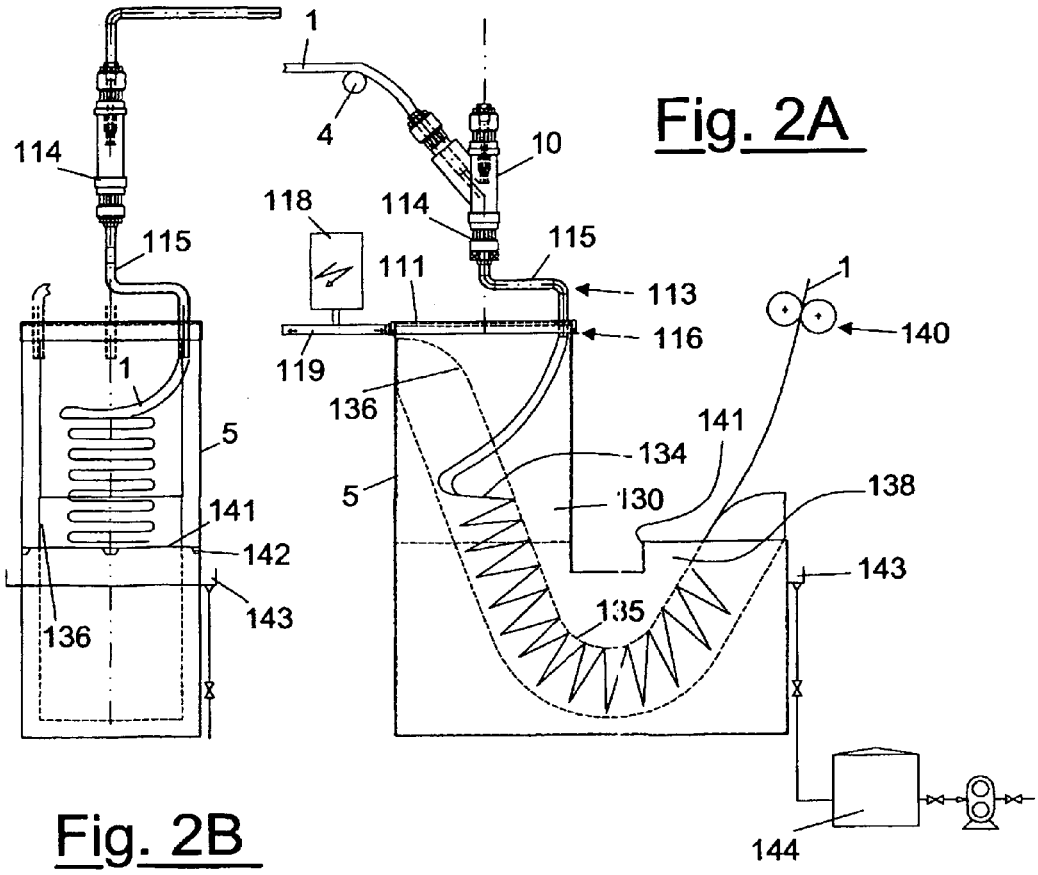
Fig. 2A
Fig. 2B

DEVICE FOR THE CONTINUOUS TREATMENT OF YARNS WITH PROCESS FLUIDS

The present invention relates to the treatment of yarns with process fluids to give them the desired characteristics before their final use for producing fabrics or other end-products. In textile technology, the treatment of yarn with fluids, or more specifically with process liquids such as dyes, bleaches, mercerizing solutions, sizes, etc., is adopted for a wide variety of processings, for different types of fibers such as cotton, wool, silk, linen, etc., which give the yarn the desired characteristics or remove undesired components that reduce their value and the possibility of use for producing end-products. For cotton, for example, this type of treatment can relate to dyeing, mercerizing, bleaching, washing, sizing and so forth.

In the known art, these treatment operations are generally effected with batch operations on discrete lots of yarns, specifically prepared in bobbins or skeins, which must then be reeled off and re-prepared differently in the production line which leads to the end-product.

Batch processing on yarn is generally extremely onerous due to the considerable labour involved, the low performance of the process fluids, the high plant investments and finally for the environmental implications caused by the reagents discharged with the waste water which consequently require further costs in order to ensure that the drain water is within specification. Batch treatment also has the additional problem of quality constancy of the product for each processing batch, depending on the variability of the parameters of each single batch processing such as temperatures, times, concentrations, etc.

The economy, efficiency and constancy of the quality of the yarn treated with continuous processing is therefore determinant for the commercial success of the overall yarn production process.

To provide a better illustration of the characteristics of the continuous treatment system of yarn with process fluids, in the description of the present invention, reference is made to treatment with the mercerization—also called mercerizing—reaction of cotton, which represents a typical case of yarn treatment with process solutions; it should be explicitly specified, however, that the continuous treatment system of yarn according to the present invention can also be advantageously used for other treatment to be effected on yarns in textile technology.

In the known art, mercerizing is typically effected on yarn in skeins, specifically prepared with a reeling step, subjected to batch mercerization, and subsequently drawn, washed, dried, reeled off and re-prepared in bobbins. Broadly speaking, mercerization consists in treating the yarn with alkaline solutions—typically caustic soda but possibly also with other alkaline hydrates—at a high concentration followed by drawing which basically enhances the yarn considerably, with respect to gloss, higher mechanical properties and improved dyeability, modifying the chemical characteristics and form of the single fibers which make up the yarn.

The objective of the present invention is to produce a device for the continuous treatment of yarns with process fluids which overcomes the disadvantages of the known devices in the state of the art.

The characteristics and advantages of the device according to the present invention for the continuous treatment of yarns with process fluids will appear more evident from the following illustrative but non-limiting description, referring to its application to the continuous mercerization under tension of cotton, according to the reactor scheme illustrated in FIG. 1.

FIGS. 1A, 1B and 1C illustrate the constructive and functional characteristics of an illustrative embodiment of the continuous treatment device according to the invention. FIG. 1A represents a side view of the reactor and its service equipment, whereas FIG. 1B shows a view from the left and FIG. 1C the section of the reactor 5. FIGS. 2A, B, C illustrate an alternative embodiment of the device according to the invention.

The treatment illustrated in the embodiments described hereunder can also be effected on a single thread, but for the industrial application of the invention, it is economically more interesting—for the productivity of the device—to operate on a series of threads, preferably joined in a bundle forming a group of threads, generally with from 20 to 200 threads or more also depending on the number of the yarn being processed.

In the case of breakage of one or more single threads of the bundle 1, solidarity among the thread components is preferably given to the bundle 1, in order to prevent them from continuing their run in the overall treatment equipment, allowing them, with continuous feeding, to accumulate inside one of the machines operating in continuous. In order to increase this solidarity of the threads contained in the bundle of threads 1 to be sent for processing, for example, in the previous section for the preparation of the bundle of threads, not shown in the figure for the sake of simplicity, resort can be made to the expedient of winding one or more auxiliary threads around them, which accompany the bundle along the treatment and which are then separated and re-used.

This expedient, in the case of the breakage of one or more single threads 1, prevents them from not continuing their run through the overall machinery but, with continuous feeding, allows them to accumulate in one of the continuous processing machines. An alternative for increasing the adherence between the threads of the bundle 1 can be to apply a slight twisting to the bundle itself, a few twists per meter, assembling the creel of the bobbins from which the threads are sent individually, on a rotating support, according to the rope-making technique.

The feeding of the bundle of threads 1 is obtained with a pair of guiding rolls 2, which rotate at a controlled rate and which determine the linear flowrate of the bundle of threads 1 being treated, generally at a rate in the order of hundreds of m/minute, sending it to the mercerizing section.

An important characteristic of the present invention consists in the structure of the reactor in which the treatment of the bundle of threads 1 is effected with the process fluid which, for example, consists of an alkaline solution of sodium hydrate at a high concentration. This operation is carried out in a tank reactor, internally equipped with a saddle-shaped guiding surface of the layer of threads in swirls. In the illustrative embodiment of FIG. 1, the reactor 5 is tubular and has the form of a J or asymmetrical U, which means that the bundle of threads continuously moves first with a downward movement in which it is immersed in the bath, followed by an upward movement with emersion from the treatment bath.

The bundle of threads 1 is deviated with the deviator roll 4 and introduced into the mercerizing reactor 5, by means of a Venturi nozzle 10 fed with a pressurized stream of the treatment fluid, for example the alkaline mercerizing solution. The bundle 1 is inserted in the Venturi through one of its side openings 11, in correspondence with the depression of the contracted vein of the driving fluid. The stream therefore sucks up the bundle of threads 1, released by the guiding rolls 2 and subsequently sent to the treatment reactor. From the Venturi 10, the bundle of threads 1 is introduced, by means of a distributor 13, with a swirl configuration into the peripheral interspace of the reactor 5.

The distributor 13 is connected to the final part of the Venturi 10, from which the treatment solution flows entraining with it the bundle of threads 1 at the rate allowed by the guiding rolls 2. The connection of the distributor 13 is effected with a vertical cylindrical joint 14, which ends with a deviator tube 15, having an eccentric terminal part capable of rotating around the axis of the cylindrical joint 14, depositing the yarn with swirls in the interspace 30 between the jacket of the reactor 5 and its central sheath. A pulley 16 is wedged on the initial cylindrical part of the tube 15, which is rotated by means of a motor 18, on whose axis a similar pulley 19 is assembled, which carries a transmission belt 20.

According to a preferred embodiment of the present invention, the motor 18 is an electric motor piloted in an alternating controlled rotation frequency, clockwise and anticlockwise, according to a swing angles between 90° and 180°, for example with so-called brushless motors, or with step-by-step motors piloted in frequency by a processor which allows the thread to be deposited at a rate coherent with that of the rolls 2 and with a swirl form having an angular amplitude corresponding to the swing angles of the end of the tube 15. Both the Venturi 10 and the upper part of the reactor 5 are positioned with their axis in a vertical or subvertical position, i.e. deviated by a few degrees with respect to the vertical.

The swirls of the bundle of threads 1 being treated are deposited as a layer 34 which slowly descends onto the saddle 35 of the concave part of an inaccessible sheath 36 and then rises up to the outlet section 38, pulled by the discharge rolls 40.

Overflow mouths 42 are situated on the outlet edge of the jacket 41 of the treatment reactor, from which the treatment solution, for example the mercerizing solution, overflows into the underlying tank 43 from which the solution is then removed and reused.

The type of contact and residence times of the yarn of the bundle 1 in the reactor 5 can be regulated and controlled according to a large quantity of variables, with the same linear flow-rate of the bundle of threads 1 being treated. For example, the parameters can be—either jointly or separately—the variation of the $\alpha$ swing angle of the tube 15 of the distributor 13 or the swing frequency, by intervening on the piloting of the activation motor 18, or the delay or the pulling rate with the discharge rolls 40, by intervening on their activation.

As already specified, inside the reactor there is a saddle-shaped guiding surface 35 of the layer of threads in swirls. In the embodiment of FIG. 1, it consists for example—but not necessarily—of an inaccessible metallic sheath 36, also J-shaped, which forms an interspace with a circular crown section, with an upper saddle 35 on which the yarn body positioned in swirls moves from the entrance to the exit, in contact with the caustic mercerizing solution which fills the interspace of the reactor up to its overflow level. This preferential structure allows the internal volume of the treatment reactor 5 to be reduced to the minimum, together with the quantity and residence time of the treatment solution.

Said solution percolates in the bundle of threads which, deposited in swirls, for example, in a zigzag arrangement, on the external surface of the sheath 36, slowly moves along the J remaining in contact with the solution for the necessary time.

In the embodiment of FIG. 1, the jacket of the reactor 5 is completely open in correspondence with the inlet of the treatment fluid together with the bundle of yarn 1 and the separate outlet of the bundle and solution from the overflow. In some processings, it is preferable to avoid any possible leakages and losses of treatment fluid at the inlet where there can be significant flow-rates. FIGS. 2A, 2B illustrate an alternative embodiment of the device according to the invention with a greater control and seal of the flow at the inlet, for example for the dyeing operations of the yarn.

FIG. 2A represents a side view of the reactor and its service equipment, whereas FIG. 2B shows its view from the left and FIG. 2C the upper view of the rotating distributor.

In the illustrative embodiment of FIG. 2, the tank jacket of the reactor 5 is a casing and in the form of a J, or L, which means that the bundle of threads in continuous is first immersed in and then emerges from the treatment bath.

The introduction system of the bundle of threads 1 into the treatment reactor 5, with the Venturi 10 fed with a pressurized stream of the treatment fluid follows the embodiment of FIG. 1.

The bundle of threads 1 is introduced, by means of a distributor 113, from the Venturi 10, again with a swirl configuration on the saddle-shaped surface inside the reactor 5. The reactor is equipped in the upper end of the inlet with a rotating lid 111 with respect to the jacket of the tank 5, which prevents the external leakage of fluid due to the movement of the distributor.

Analogously to what is described above, the distributor 113 is connected to the final part of the Venturi 10 with a vertical cylindrical joint 114, which ends with a deviator tube 115, having an eccentric terminal part capable of rotating around the axis of the cylindrical joint 114, depositing the yarn with swirls. On the final eccentric part of the tube 115, a further connection joint 116 is wedged with a circular rotating lid 111, coaxial with the cylindrical joint 114. This rotating lid is supported by the jacket with the interposition of low friction sliding devices, already known, and is moved in alternating and controlled rotation by a motor 118, by the interposition of a transmission of the type known in the art, for example a geared transmission 119 which fits into a corresponding toothed section 120 connected to the rotating lid 111. The alternating rotating motor can derive from the continuous rotating movement of a motor with the interposition of a classical cinematic connecting rod/handle system.

For the purposes of adaptability to the demands of different processings, the embodiment comprising activation of the distributor 113 with an electric motor 118 piloted in an alternating controlled rotation frequency, clockwise and anticlockwise, according to a swing angles between 90° and 180°, as described in the embodiment illustrated in FIGS. 1A, B, C, is still useful.

The swirls of the bundle 1 of threads being treated are deposited in the form of a layer 134 which is deposited in the interspace 130 between the jacket of the tank 5 and the internal surface 136 and which slowly descends onto the saddle 135 of the concave part of said internal surface 136. This surface can be either open or inaccessible, with a straight transversal or convex trend of the surface in contact with the layer 134 of yarn which runs along it and rises up to the exit section 138, by the pulling exerted by the discharge rolls 140. In FIG. 2B the surface 136 is shown with a straight transversal trend, whereas in FIG. 1, it is convex.

Again for limiting losses of treatment fluid, one or more overflow mouths 142 are situated on the outlet edge of the jacket 141 of the treatment reactor, from which the treatment solution overflows into a peripheral channel 143 which collects the overflow fluid and sends it to the underlying tank 144 from which the solution is then removed with a relaunching pump.

The treatment device of the yarns according to the present invention allows considerable advantages with respect to the known art. Among these special mention should be made to the following characteristics. For the purposes of the product quality and treatment completeness, the dynamics of the contact between the yarn and solution is extremely important. The contact takes place, in fact, in two steps and ensures an effective treatment. The first step is effected inside the Venturi nozzle 10 and distributor 13 (or 113) at a high rate: in these devices there is a vortical flow and brusque involvement also of the threads situated inside the bundle 1. The second step takes place over a longer period of time and in the interspace of the reactor 5, on the bundle deposited in swirls with a flow in laminar regime in which the permeation and reaction of the solution inside the single threads are gradual and complete.

The structure of the reaction device 5 also overcomes problems relating to the dimensional variations of the yarn subjected to treatment. In the specific case of mercerizing, there are considerable variations in the length of the thread during treatment. These variations in length are entirely compensated with the distribution of the bundle 1 in swirls in the reactor with the distributor 13, and by activating the discharge rolls 40 at a linear rate corresponding to that of the initial rolls 2, thus calculating the variation in the shortening due to the mercerization.

With the device according to the present invention, the treatment operations are effected in continuous, and not in small batches, without requiring previous preparation in bobbins or skeins followed by unwinding and re-preparation. With the device according to the present invention, the continuous processing of the yarn is consequently more economical, both due to the lesser amount of labour used, the high performance of the process fluids and washing water, the higher plant productivity and lower plant investments required with the same productive capacity, and finally fewer environmental problems as a result of the reduced quantity of reagents discharged with the waste water. The constancy of the product quality which is obtained with the continuous treatment system according to the present invention is considerably improved, due to the constancy of the parameters of each processing step which can be maintained at the desired temperature, time, concentration values, and so forth.

The particular conformation of the treatment reactor with a relative double motion regime of the fluid and yarn, a Venturi nozzle and underlying tank, allows the process conditions and times to be regulated within a wide range without influencing the treatment capacity.

The invention claimed is:

1. Device for continuous treatment of yarns with process fluids characterized in that it comprises:

means for introducing yarn threads which are fed for treatment by suction with a Venturi Nozzle (10), in which the process fluid is fed as driving fluid, entraining with it the yarn (1), either single or in a bundle, a distributing device, characterized as hollow tubes (13, 113) which receive the bundle of yarn (1) and distribute it into a treatment reactor (5) forming a layer (34, 134) with superimposed swirls, tank reactors (5), internally containing a saddle shaped guiding surface (35, 135) on which the bundle of threads (1) deposited in a layer (34, 134) of swirls moves continuously first with a downward motion immersing it in a process fluid bath, and then with an upward motion with emersion from said bath, rising to an exit by a pulling of a discharge roll (40, 140).

2. Device for the continuous treatment of yarns with process fluids according to claim 1, characterized in that the tank reactor (5) is in the form of a J, characterized by a straight portion and a curved portion, further characterized by an outer jacket and an internal, inaccessible sheath (36), also J-shaped, the bundle descending in a layer (34) on the curved portion of the inaccessible sheath (36).

3. Device for the continuous treatment of yarns with process fluids according to claim 1, characterized in that the distributing devices, having two ends (13, 113) are connected by one end to the Venturi (10) by means of a cylindrical joint, said cylindrical joint having the capability to rotate perpendicular to the direction of the movement of the yarn (14, 114), said distributing device is further characterized by an eccentric terminal part of the tube (15, 115) the entire distributing device is capable of rotating with the cylindrical joint around the axis of the cylindrical joint (14, 114), said eccentric end thereby deposits the yarn in swirls in an interspace (30, 130) between the outer jacket and the internal inaccessible sheath(36), said distributor being further characterized by having a clockwise and anti-clockwise, alternating angular swing.

4. Device for the continuous treatment of yarns with process fluids according to claim 3, characterized in that the clockwise and anticlockwise, alternating angular swing is activated according to ($\alpha$) rotation angles ranging from 90° to 180°.

5. Device for the continuous treatment of yarns with process fluids according to claim 3, characterized in that the rotating cylindrical joint is activated by an electric motor (18, 118) piloted by frequency.

6. Device for the continuous treatment of yarns with process fluids according to claim 3, characterized in that the distributing devices (113) are connected to the Venturi (10) with a cylindrical joint (114), which ends with a terminal eccentric part of the tube (115), which in turn is connected to a circular rotating lid (111) coaxial with the cylindrical joint (114), supported by the jacket of the reactor (5) and which is moved in an alternating and controlled rotation by means of a motor (118).

7. Device for the continuous treatment of yarns with process fluids according to claim 6, characterized in that the activation of the rotating lid (111) is effected with the interposition of a geared transmission (119, 120).

8. Device for the continuous treatment of yarns with process fluids according to claim 6, characterized in that the alternating rotating motion of the rotating lid (111) derives from the continuous rotating motion of a motor with the interposition of a connection rod-handle system.

* * * * *